United States Patent [19]

Fehlau

[11] 4,347,945

[45] Sep. 7, 1982

[54] PUMP CLOSURE FASTENING MEANS

[75] Inventor: Rudolf Fehlau, Downey, Calif.

[73] Assignee: Borg-Warner Corporation, Chicago, Ill.

[21] Appl. No.: 260,611

[22] Filed: May 5, 1981

[51] Int. Cl.[3] ..... B65D 45/00

[52] U.S. Cl. ..... 220/327; 292/256.71; 220/328

[58] Field of Search ..... 220/327, 378, 328, 319; 292/256.71

[56] References Cited

U.S. PATENT DOCUMENTS

| | | | |
|---|---|---|---|
| 3,451,585 | 2/1968 | Jorgensen | 220/327 |
| 3,805,992 | 4/1974 | Jorgensen | 220/327 X |
| 3,915,337 | 10/1975 | Parsels | 220/327 |
| 4,240,561 | 12/1980 | Hagstrom et al. | 220/327 X |

OTHER PUBLICATIONS

The Shear Stud Closure by S. M. Jorgensen, "Transactions of the ASME", May, 1974, pp. 81–86, incl.

*Primary Examiner*—George T. Hall
*Attorney, Agent, or Firm*—Aubrey L. Burgess

[57] ABSTRACT

A closure arrangement for a pump housing having a generally cylindrical bore, comprising a closure member connected to the housing by a closure ring and a plurality of shear studs received in threaded openings, a portion of each opening being in the housing member and a portion being in the closure ring, and locking or compression means comprising compression bolts received in the closure ring and acting on the closure member.

5 Claims, 2 Drawing Figures

PUMP CLOSURE FASTENING MEANS

BACKGROUND OF THE INVENTION

A conventional closure arrangement for pumps utilizes studs and nuts for attachment of the pump cover to the pump barrel, and to maintain sealing loads on gaskets in the assembly. A prestress of the studs is required to maintain sealing when the studs are loaded due to hydraulic pressure forces acting on the pump cover, and also to minimize elongation of the studs in order to maintain sufficient seating load on the gaskets, which may be of the spiral wound, metalasbestos type or of the O-ring variety. Accurate prestressing or torqueing of conventional studs is required, necessitating special tooling, such as stud tensioning devices, torque wrenches and/or impact wrenches. Large bolts and/or studs are required to carry the applied loads, necessitating heavy material sections and thick flanges, as well as extended diameters to accommodate the large bolts and/or studs. Thick covers are required to minimize deflections as the gasket seating load is not acting at the gasket diameter.

THE INVENTION

The invention disclosed herein relates to a closure arrangement which utilizes shear studs subjected to shear loads and bolts subjected to compression forces to achieve gasket seating and the carrying of hydraulic end forces in a pump assembly. Prestressing of stubs to maintain sealing, as used on conventional arrangements, is not required. The arrangement to be herein described eliminates the need for special tooling and tensioners and eliminates the need for torqueing of studs.

The shear stubs, as described herein, need only be engaged sufficiently to provide the required shear area. This is conveniently provided for by the depth of the threaded engagment of the shear studs and the receiving shear stud receiving openings. The compression of gaskets in the pump assembly is achieved by tightening compression bolts, as will be described. Because the length of the compression bolts subject to forces is relatively small, deformation of the compression bolts under load is minimal, therefore eliminating the need for high torqueing to maintain seating forces on the gaskets. Seating forces as maintained are in line with the gasket, i.e., are applied to the same diameter.

The arrangement herein described has major advantages over prior art or conventional pump closure arrangements. The amount of construction materials can be reduced, i.e., the diameters of the pump barrel and the pump cover are reduced, resulting in savings of materials and machining costs as well as easier handling of the parts during machining and assembly. Of special note is the ease of handling and reduced service time in field service with only conventional tools required. There is no need for tensioning fixtures, torque or impact wrenches or equipment to measure prestress values. These and other advantages will become apparent to one skilled in the art.

THE DRAWINGS

FIG. 1 is a partial sectional view of a pump closure according to this invention; and FIG. 2 is a view taken on line 2—2 of FIG. 1.

DETAILED DESCRIPTION

Figure 1:
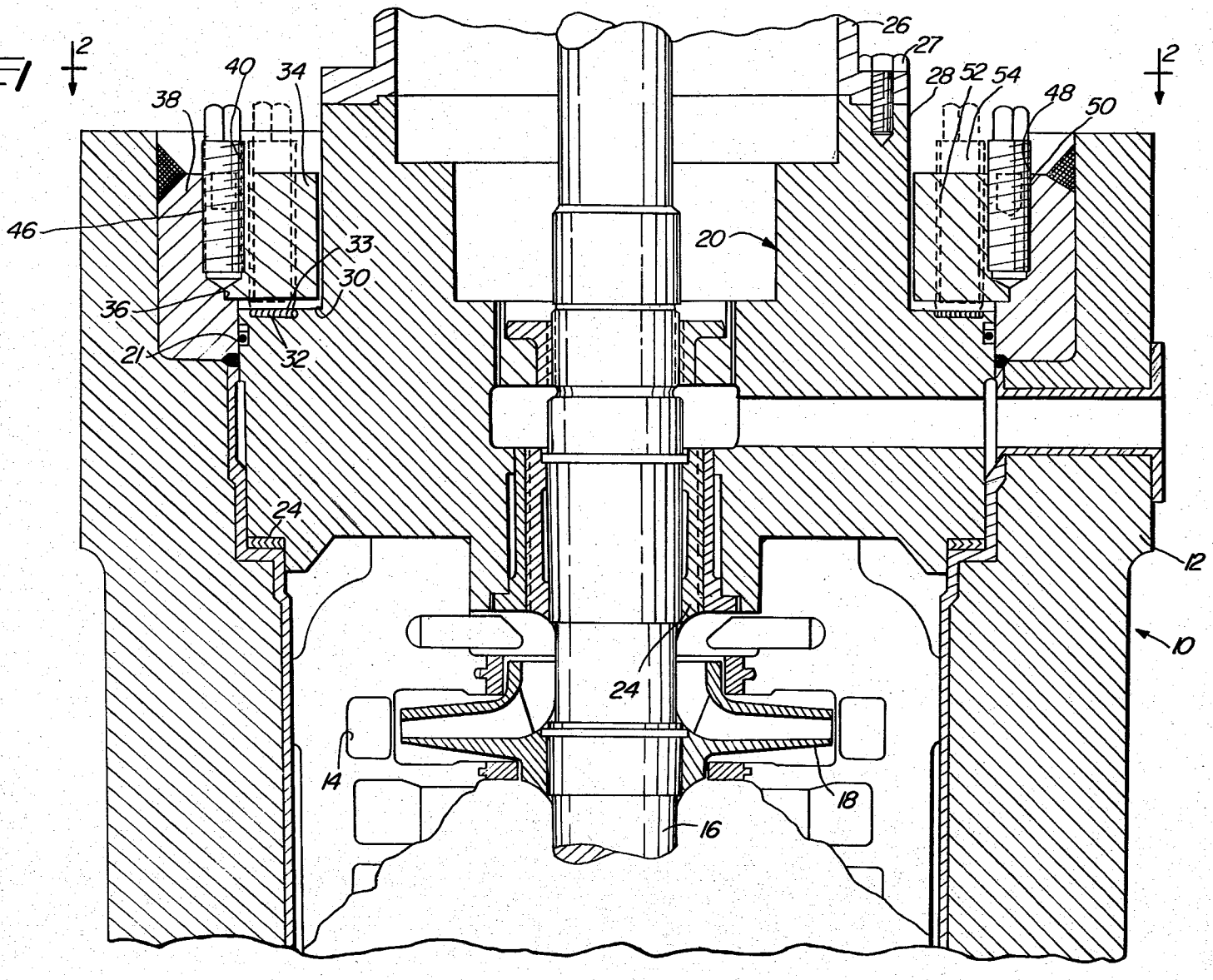
Figure 2:
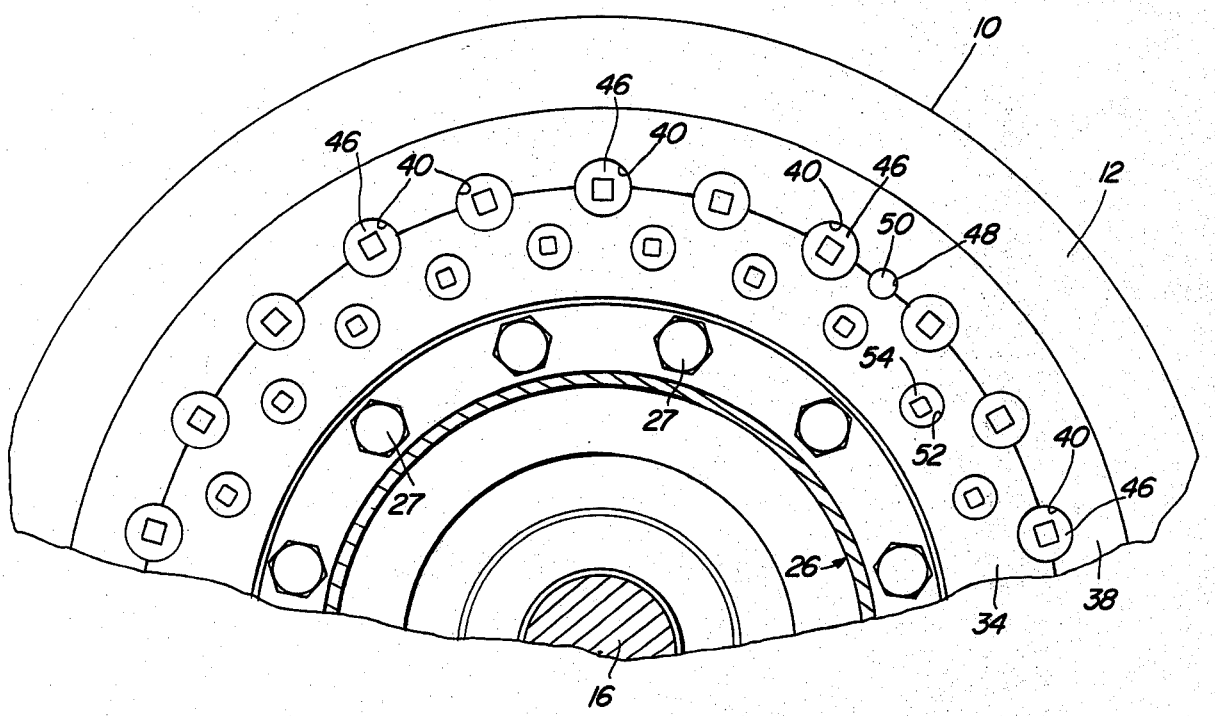

The drawing illustrates a portion of a pump 10 comprising a radially split pump-case barrel 12 housing the volute case 14, a rotary shaft 16 and one or more pump impellers 18 connected to the shaft 16 and discharging into the volute 14. The end of the barrel 12 is closed by an annular pump cover 20 sealed to the barrel by gaskets 21 and 24 and the like and having suitable bearings to journal the shaft 16. The gaskets can be of the spiral wound type of a metal-asbestos combination or of the O-ring variety, as is known in the art. The volute case 14 abuts the cover 20 and the driver unit 26 is bolted to the cover 20 by bolts 27, as shown. Various provisions for pump thrust balance, throttle bushings, seals, recirculation or outlet provisions and provisions for mounting pump bearings are housed in the pump cover; such are not part of the present invention except to provide a complete assembly. While the invention is described with respect to split pump-case pumps, it is equally applicable to other known types of pumps.

The closure cover 20 has a reduced diameter portion 28 at its end to define an annular surface 30 with an annular insert 32 therein having a hard faced or spot surface 33. Other types of inserts may also be used. An annular closure ring 34 surrounds the portion 28 and has a portion received in a recess 36 in a ring member 38 welded to a portion of the barrel 12. As an alternative, the insert 34 may closely fit into a recess in the pump barrel 12, eliminating the need for the ing member 38. Tapped holes 40 are provided at the fit diameter of the rings 34 and 38 or ring 34 and barrel 12, as the case may be. Half the holes 40 are in the ring 34 and half are in the ring 38 or half are in the ring 34 and half are in the barrel 12, as the case may be. Each hole 40 receives a shear stub 46. The holes 40 are preferably drilled and tapped in one operation. Because high torque is not required for assembly, the shear studs made with square heads for engagement by a suitable wrench, thus eliminating the need for a large head. To maintain proper positioning of the shear stud holes 40, at least one locating dowel 50 is received in hole 48 formed half in the closure ring 34 and half in the ring member 38 and at the same fit diameter as the holes 40.

The closure ring 34 is drilled and tapped to provide a plurality of generally equally spaced holes 52 each to receive a compression bolt 54, the end of which contacts the hard face 33 of the insert 32. Each bolt 54 can have a square head for engagement by a suitable wrench. The compression bolts 52 provide and maintain compression on the pump gasket by contacting the hard faced surface 33 which protects parts of the assembly. The compression bolts do not require high torque to compress the gaskets and, therefore, can have square heads for engagement by a suitable wrench. In the arrangement described, the shear studs 46 maintain the parts in assembled relationship and the compression bolts maintain loading forces on the pump cover 20 and the pump gasket.

I claim:

1. A closure arrangement for a pump housing having a generally cylindrical bore, comprising:

a closure member having a first cylindrical portion closely fitting into said bore and a second cylindrical portion defining a shoulder with said first portion which faces in an outwardly direction with respect to said housing;

a closure ring surrounding said second portion and positioned over said shoulder;

a plurality of spaced threaded openings at the juncture of the periphery of said closure ring and said housing, said openings each having a generally semi-circular portion in said closure ring and a generally semi-circular portion in said housing;

a threaded shear stud in each opening to join said closure ring and said housing; and compression means connected to said closure ring engaging said shoulder.

2. A closure arrangement as recited in claim 1, wherein said compression means comprises threaded bolts received in threaded openings in said closure ring.

3. A closure arrangement as recited in claim 2 further comprising a hardened insert in said pump housing forming a contact surface for said compression bolts.

4. A closure arrangement as recited in claim 1 further comprising a ring member joined to said housing and adjacent to said closure ring, said openings being in said closure ring and said ring member.

5. A closure arrangement as recited in claim 4, in which said ring member is welded to said housing.

* * * * *